US009929491B2

(12) United States Patent
Yamaguchi et al.

(10) Patent No.: US 9,929,491 B2
(45) Date of Patent: Mar. 27, 2018

(54) LIVE PORTION PROTECTION STRUCTURE AND CONNECTOR

(71) Applicant: YAZAKI CORPORATION, Tokyo (JP)

(72) Inventors: Yasuhiro Yamaguchi, Shizuoka (JP); Miki Nakamura, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/212,050

(22) Filed: Jul. 15, 2016

(65) Prior Publication Data

US 2016/0329651 A1 Nov. 10, 2016

Related U.S. Application Data

(63) Continuation of application No. PCT/JP2015/051426, filed on Jan. 20, 2015.

(30) Foreign Application Priority Data

Jan. 20, 2014 (JP) ..... 2014-007438

(51) Int. Cl.
*H01R 13/52* (2006.01)
*H01R 13/44* (2006.01)
(Continued)

(52) U.S. Cl.
CPC ..... *H01R 13/44* (2013.01); *H01R 11/12* (2013.01); *H01R 13/521* (2013.01); *H01R 13/6593* (2013.01)

(58) Field of Classification Search
CPC ..... H01R 13/5219; H01R 13/5202; H01R 13/521; H01R 13/5221; H01R 13/523; H01R 13/5208; H01R 13/5205
(Continued)

(56) References Cited

U.S. PATENT DOCUMENTS 4,921,437 A * 5/1990 Cooper ..... H01R 13/4223 439/275
8,231,408 B2 * 7/2012 Ebihara ..... H01R 13/5205 439/587
(Continued)

FOREIGN PATENT DOCUMENTS

JP 2002-318330 A 10/2002
JP 2011-54393 A 3/2011
JP 2012-64428 A 3/2012

OTHER PUBLICATIONS

International Search Report and Written Opinion of the International Search Report for PCT/JP2015/051426 dated Mar. 17, 2015.
(Continued)

*Primary Examiner* — Hien Vu
(74) *Attorney, Agent, or Firm* — Kenealy Vaidya LLP

(57) ABSTRACT

A live portion protection structure includes a high-voltage electric wire that has a conductor and an insulating cover covering the conductor, a conductive terminal fitting that is connected to the conductor exposed from the high-voltage electric wire, an insulating housing that receives a connection part between the terminal fitting and the conductor, a regulation member that is disposed in a reception path for receiving the connection part into the housing, and an insulating extra-length portion that is provided in the cover. When a part or all of the connection part on a side of the conductor drops out from the housing, the extra-length portion abuts against the regulation member so as to be moved to an outside of the part or all of the connection part to thereby cover the part or all of the connection part.

9 Claims, 15 Drawing Sheets

(51) Int. Cl.
*H01R 11/12* (2006.01)
*H01R 13/6593* (2011.01)

(58) Field of Classification Search
USPC ..... 439/271, 587
See application file for complete search history.

(56) References Cited

U.S. PATENT DOCUMENTS

| | | | | |
|---|---|---|---|---|
| 9,059,534 | B2 * | 6/2015 | Endo | H01R 13/5205 |
| 2011/0207354 | A1 | 8/2011 | Tashiro | |
| 2013/0017719 | A1 * | 1/2013 | Tanaka | H01R 9/032 439/587 |
| 2013/0153294 | A1 | 6/2013 | Adachi et al. | |
| 2014/0106588 | A1 * | 4/2014 | Suzuki | H01R 13/5219 439/271 |
| 2014/0287631 | A1 * | 9/2014 | Tashiro | H01R 13/521 439/733.1 |

OTHER PUBLICATIONS

English language Written Opinion of the International Search Report for PCT/JP2015/051426 dated Mar. 17, 2015.

* cited by examiner

LIVE PORTION PROTECTION STRUCTURE AND CONNECTOR

CROSS REFERENCE TO RELATED APPLICATIONS

This application is a continuation of PCT application No. PCT/JP2015/051426, which was filed on Jan. 20, 2015 based on Japanese Patent Application (No. P2014-7438) filed on Jan. 20, 2014, the contents of which are incorporated herein by reference.

BACKGROUND OF THE INVENTION

1. Field of the Invention

The present invention relates to a protection structure for a case where disconnection occurs in a connector provided at an end portion of a high-voltage electric wire that is an electric wire for high voltage, or a protection structure for a case where a conductor of a high-voltage electric wire has dropped out from a connection part between the conductor and a terminal fitting in a connector, and a connector using such a protection structure.

2. Description of the Related Art

For example, an inverter unit and a battery mounted on a hybrid car or an electric car are electrically connected to each other through a wire harness for a high voltage application (herein abbreviated to high voltage simply). The high-voltage wire harness includes a plurality of high-voltage electric wires, a shield connector provided at end portions of the high-voltage electric wires, and a shield member provided outside the high-voltage electric wires.

In FIGS. 13 to 15, a shield connector 101 is provided at end portions of three high-voltage electric wires 102. Such a shield connector 101 includes terminal fittings 103, a housing 104, rubber plugs 105, seal rings 106, a packing 107, spacers 108, a rear holder 109, a shield shell 110, and a shield ring 111 (refer to a shield connector disclosed in JP-A-2011-54393).

The terminal fittings 103 are conductive metal components. The terminal fittings 103 are connected to conductors 112 exposed from the end portions of the high-voltage electric wires 102. The terminal fittings 103 and the conductors 112 are connected by caulking (crimping) as illustrated.

The housing 104 is an insulating component formed by resin molding. The housing 104 has reception portions 113 for receiving the end portions of the electric wires and the terminal fittings 103. When the terminal fittings 103 are received in the reception portions 113, the housing 104 can protect connection parts between the terminal fittings 103 and the conductors 112 from the outside.

The rubber plugs 105 are placed at the end portions of the high-voltage electric wires 102 in advance. The rubber plugs 105 are received in the reception portions 113 together with the terminal fittings 103. When the rubber plugs 105 are received in the reception portions 113, the rubber plugs 105 are brought into tight contact with covers 114 of the high-voltage electric wires 102 and the inner surfaces of the reception portions 113 to prevent moisture or the like from invading. That is, the rubber plugs 105 function as waterproofing members.

The seal rings 106 also function as waterproofing members in the same manner as the rubber plugs 105. Specifically, the seal rings 106 are brought into tight contact with the terminal fittings 103 and the inner surfaces of the reception portions 113 to prevent moisture or the like from invading. The packing 107 is brought into tight contact with a not-shown shield case of a high-voltage device to prevent moisture or the like from invading. The packing 107 is placed in an annular packing groove formed in a surface of a flange portion 115 facing the device.

The spacers 108 are resin components for locking the terminal fittings 103 received in the reception portions 113 of the housing 104. When each spacer 108 is fitted to the housing 104, a part of the spacer 108 is inserted into a lock hole formed in an intermediate portion of a corresponding one of the terminal fittings 103 to thereby lock the terminal fitting 103. The terminal fitting 103 is put in an immobile state by the spacer 108 (the terminal fitting 103 itself is also fixed by connection on the high-voltage device side).

The rear holder 109 is a resin component for pressing the rubber plugs 105 received in the reception portions 113 of the housing 104 while pinching the three high-voltage electric wires 102. The rear holder 109 is caught and locked to lock protrusions protruding in a rear portion of the housing 104.

The shield shell 110 is a conductive metal component. The shield shell 110 is placed outside the housing 104 and fixed to the not-shown shield case of the high-voltage device by bolting. Incidentally, when the shield shell 110 is fixed to the shield case, the housing 104 is also put in an immobile state. The shield shell 110 has a cylindrical portion 116. For example, end portions of shield members 117 such as braids are put over the cylindrical portion 116.

The shield ring 111 is an annular metal component provided outside the cylindrical portion 116. The shield ring 111 is deformed by caulking so that the shield members 117 can be fixed onto the cylindrical portion 116. The shield members 117 have conductivity, and are grounded to the not-shown shield case of the high-voltage device through the shield shell 110. The shield members 117 are formed into a cylindrical shape to cover the three high-voltage electric wires 102 in a lump.

A high-voltage wire harness having a configuration including the shield connector 101 arranged thus is, for example, arranged to pass through a vehicle underfloor and connect an engine room with a vehicle rear portion.

In the aforementioned background art, the high-voltage electric wires 102 are prevented from dropping out from the housing 104 due to the structure of the rear holder 109 and so on. However, a structure for protecting a live portion is required even when disconnection occurs.

SUMMARY OF THE INVENTION

The present invention has been developed in consideration of the aforementioned situation. An object of the invention is to provide a live portion protection structure and a connector capable of securing safety, for example, even when disconnection occurs.

In order to solve the foregoing problem, a live portion protection structure according to the invention including:

(1) a high-voltage electric wire that comprises a conductor having conductivity and an insulating cover covering the conductor; a conductive terminal fitting that is connected to the conductor exposed from the high-voltage electric wire; an insulating housing that receives a connection part between the terminal fitting and the conductor; a regulation member that is disposed in a reception path for receiving the connection part into the housing; and an insulating extra-length portion that is provided in the cover, wherein when a part or all of the connection part on a side of the conductor drops out from the housing, the extra-length portion abuts against the regulation member so as to be moved to an outside of the part or all of the connection part to thereby cover the part or all of the connection part.

According to the invention characterized thus, for example, even when the high-voltage electric wire is dropping out from the housing with a disconnection part protruding due to disconnection occurring in the connection part between the terminal fitting and the conductor, the disconnection part is covered with the extra-length portion in the dropping-out process of the high-voltage electric wire. Thus, exposure of the disconnection part or exposure of a live part can be avoided.

In the invention, the extra-length portion is, for example, a part that is formed as extra length in the cover of the high-voltage electric wire, or a part formed by a bonding agent or the like post-fitted to the cover. In addition, the part on the conductor side corresponds to the disconnection part, and the all on the conductor side corresponds to the part that has dropped out from the terminal fitting.

(2) The live portion protection structure according to the aforementioned configuration (1), wherein a misalignment preventing member that prevents misalignment of the extra-length portion is placed on the high-voltage electric wire, or a misalignment preventing structure portion that prevents misalignment of the extra-length portion is formed in the housing.

According to the invention characterized thus, due to the misalignment preventing member or the misalignment preventing structure portion, misalignment of the extra-length portion can be prevented when the end portion of the high-voltage electric wire is received into the housing. In the invention, it will go well if misalignment can be prevented when the end portion of the high-voltage electric wire is received into the housing. The extra-length portion does not hinder connecting the terminal fitting and the conductor.

(3) The live portion protection structure according to the aforementioned configuration (1) or (2), wherein a slit is provided in the extra-length portion.

According to the invention characterized thus, the shape of the extra-length portion can change smoothly, for example, when the extra-length portion abuts against the regulation member after disconnection and moves to the outside of a disconnection part to cover the disconnection part, or when the extra-length portion is placed in the housing.

(4) The live portion protection structure according to any one of the aforementioned configurations (1) through (3), wherein the regulation member is formed by an elastic body that generates a pressing force toward an inside of the electric wire.

According to the invention characterized thus, for example, when the high-voltage electric wire is dropping out from the housing due to occurrence of disconnection, a pressing force against the movement of the high-voltage electric wire acts on the high-voltage electric wire. The regulation member is a member generating a pressing force toward the inside of the electric wire. Therefore, the regulation member abuts against the cover. Since the regulation member is provided in such a position, the extra-length portion can be surely brought into contact with the regulation member in accordance with the movement of the high-voltage electric wire. As a result, the extra-length portion can be pushed out to the outside of the disconnection part so as to cover the disconnection part.

(5) A live portion protection structure according to the aforementioned configuration (4), wherein a waterproofing rubber plug is used as the regulation member; and wherein an inner face of the waterproofing rubber plug is in tight contact with the cover and an outer face of the waterproofing rubber plug is in tight contact with the housing.

According to the invention characterized thus, the function as the regulation member can be imparted to the waterproofing rubber plug. It is therefore possible to suppress increase in number of components.

(6) A connector provided at an end portion of a high-voltage electric wire, including a live portion protection structure according to any one of the aforementioned configurations (1) through (5), which is used for the connector and the end portion.

According to the invention characterized thus, the structure for protecting a live portion can be used in the connector. For example, even when the high-voltage electric wire is dropping out from the housing with a disconnection part protruding due to disconnection occurring in the connection part between the terminal fitting and the conductor, the disconnection part is covered with the extra-length portion in the dropping-out process of the high-voltage electric wire. Thus, exposure of the disconnection part or exposure of a live part can be avoided.

According to the invention stated in the aforementioned configuration (1), due to use of the structure including the insulating extra-length portion that is provided in the cover of the high-voltage electric wire, and the regulation member that operates to move the extra-length portion, for example, to the outside of a conductor-side disconnection part so that the disconnection part can be covered with the extra-length portion when disconnection occurs, there is an advantage that, for example, even when the high-voltage electric wire is dropping out from the housing with the conductor-side disconnection part protruding due to the occurrence of disconnection, the conductor-side disconnection part is covered with the extra-length portion so that the conductor-side disconnection part can be prevented from being exposed. Accordingly, there is an advantage that short-circuits or contacts of a human body can be prevented. According to the invention, therefore, there is an advantage that safety can be secured, for example, even when disconnection occurs.

According to the invention stated in the aforementioned configuration (2), due to use of the misalignment preventing member or the misalignment preventing structure portion, there is an advantage that misalignment of the extra-length portion can be prevented. Accordingly, there is no fear that misalignment occurs when the extra-length portion is assembled in the housing. As a result, there is an advantage that assemblability can be improved.

According to the invention stated in the aforementioned configuration (3), due to the slit formed in the extra-length portion, there is an advantage that the extra-length portion can be easily assembled in the housing, or the extra-length portion can be easily moved, for example, to the outside of a disconnection part due to operation from the regulation member.

According to the invention stated in the aforementioned configuration (4), due to the regulation member formed by an elastic body to generate a pressing force toward the inside of the electric wire, not only is there an advantage that the high-voltage electric wire can be prevented from dropping out easily, but there is also an advantage that the extra-length portion can be surely brought into contact with the regulation member, and further the regulation member can operate to push out the extra-length portion. Thus, there is an advantage that the extra-length portion can be surely moved to the outside of the disconnection part so as to cover the disconnection part.

According to the invention stated in the aforementioned configuration (5), the waterproofing rubber plug is also used as the regulation member. Therefore, there is an advantage that increase in number of components can be suppressed. There is an advantage that the invention can be applied to a waterproof connector.

According to the invention stated in the aforementioned configuration (6), there is an advantage that it is possible to provide a connector using a structure for protecting a live portion.

BRIEF DESCRIPTION OF THE DRAWINGS

FIG. 1A illustrates a state in which wire harnesses have been arranged in a car, and FIG. 1B is a perspective view illustrating the live portion protection structure and the connector at an end portion of one of the wire harnesses.

FIG. 12A is a sectional view of the rubber plug assembled in the connector and FIG. 12B is a perspective view of the rubber plug.

DETAILED DESCRIPTION OF THE EXEMPLARY EMBODIMENTS

A live portion protection structure is a structure in which an insulating extra-length portion is provided in cover of a high-voltage electric wire, and a regulation member is provided to be retained in a housing. For example, even when the high-voltage electric wire is dropping out from the housing with a conductor-side disconnection part protruding due to occurrence of disconnection, the regulation member acts on the extra-length portion so that the disconnection part can be covered with the extra-length portion. When the disconnection part is covered with the extra-length portion, the disconnection part can be prevented from being exposed. The disconnection part is also a live part when the high-voltage electric wire is, for example, connected to a high-voltage battery. Since such a live part is prevented from being exposed, safety can be secured.

Embodiment

Figure 1A:
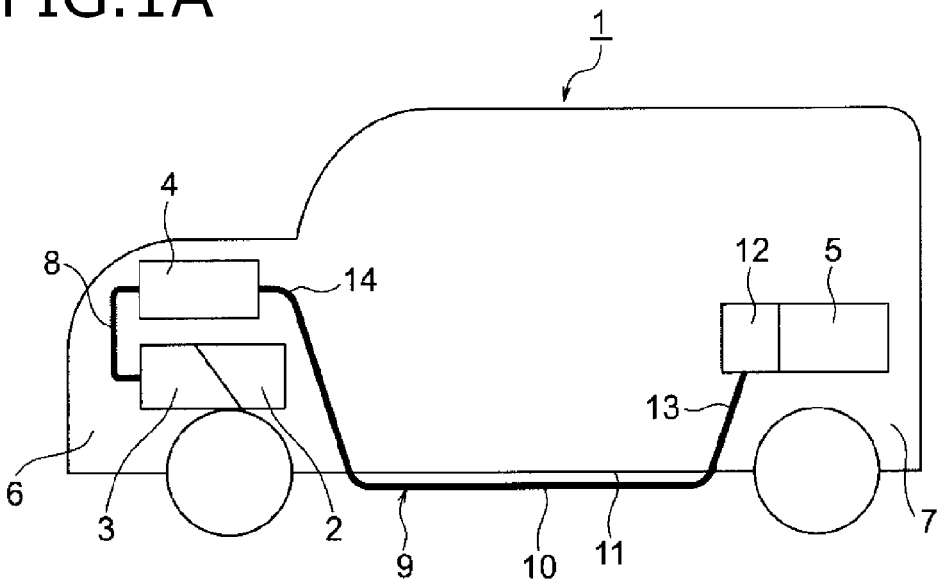
FIGS. 1A and 1B illustrate a live portion protection structure and a connector according to the invention.
Figure 1B:
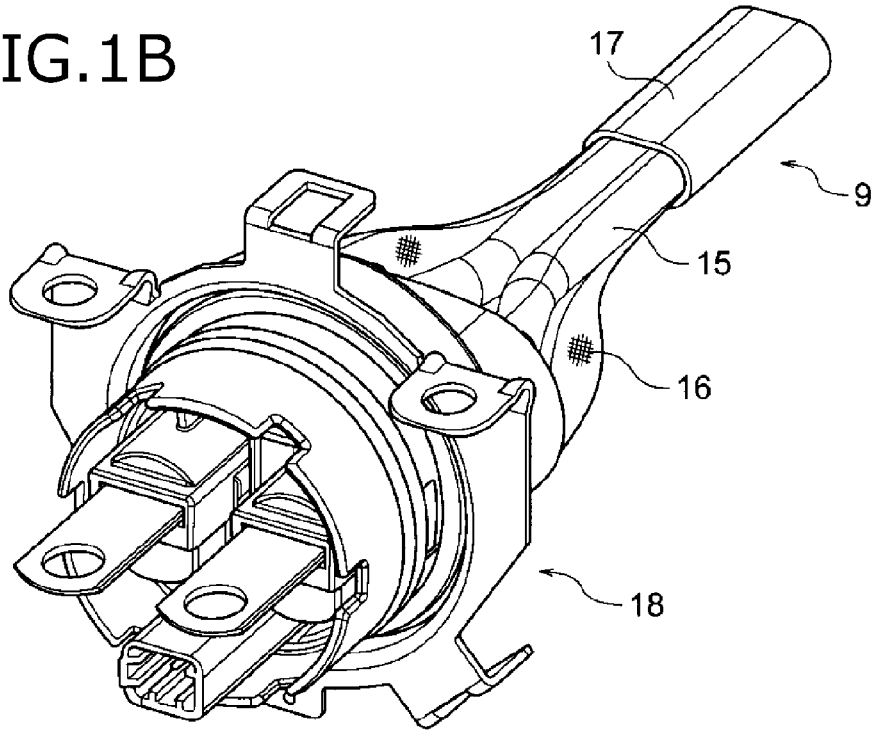
Figure 2:
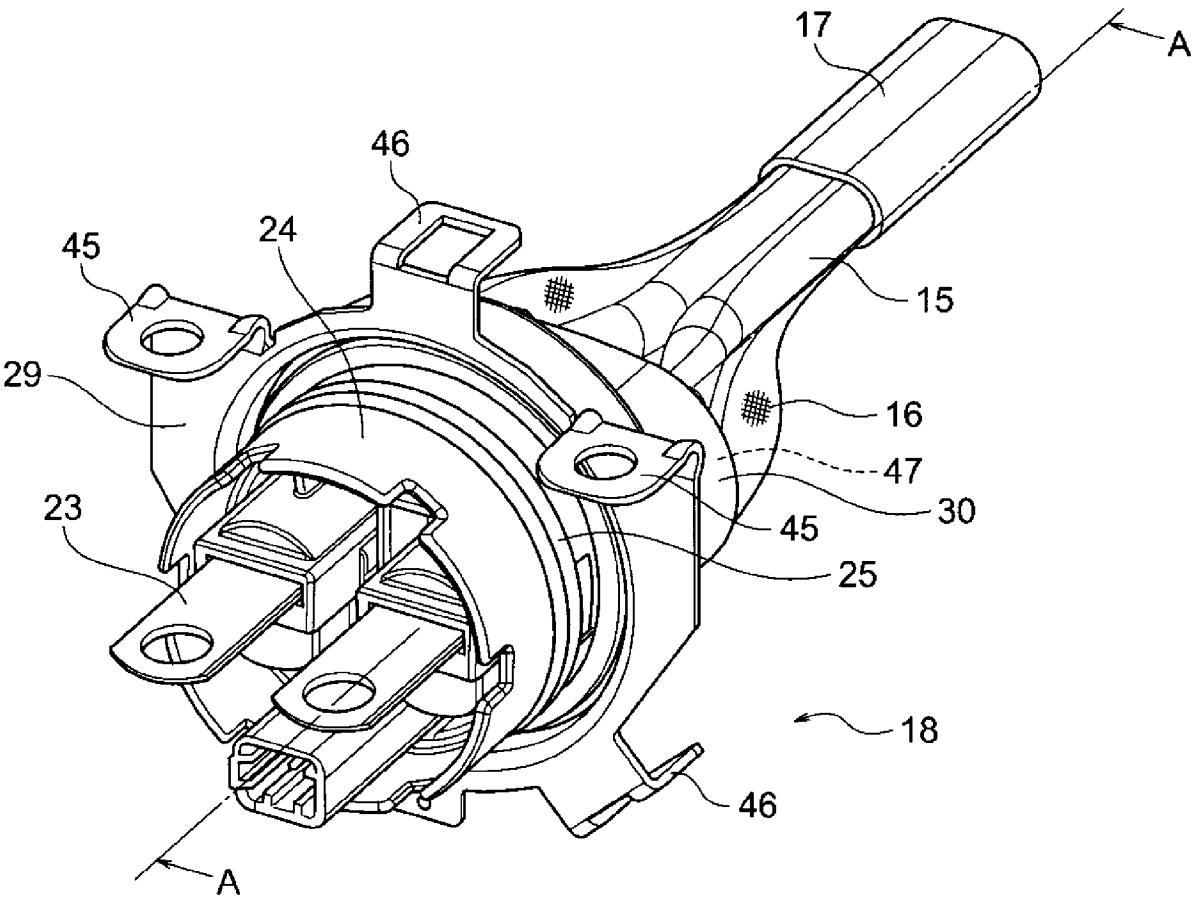
FIG. 2 is a perspective view illustrating the outline of a shield connector.
Figure 3:
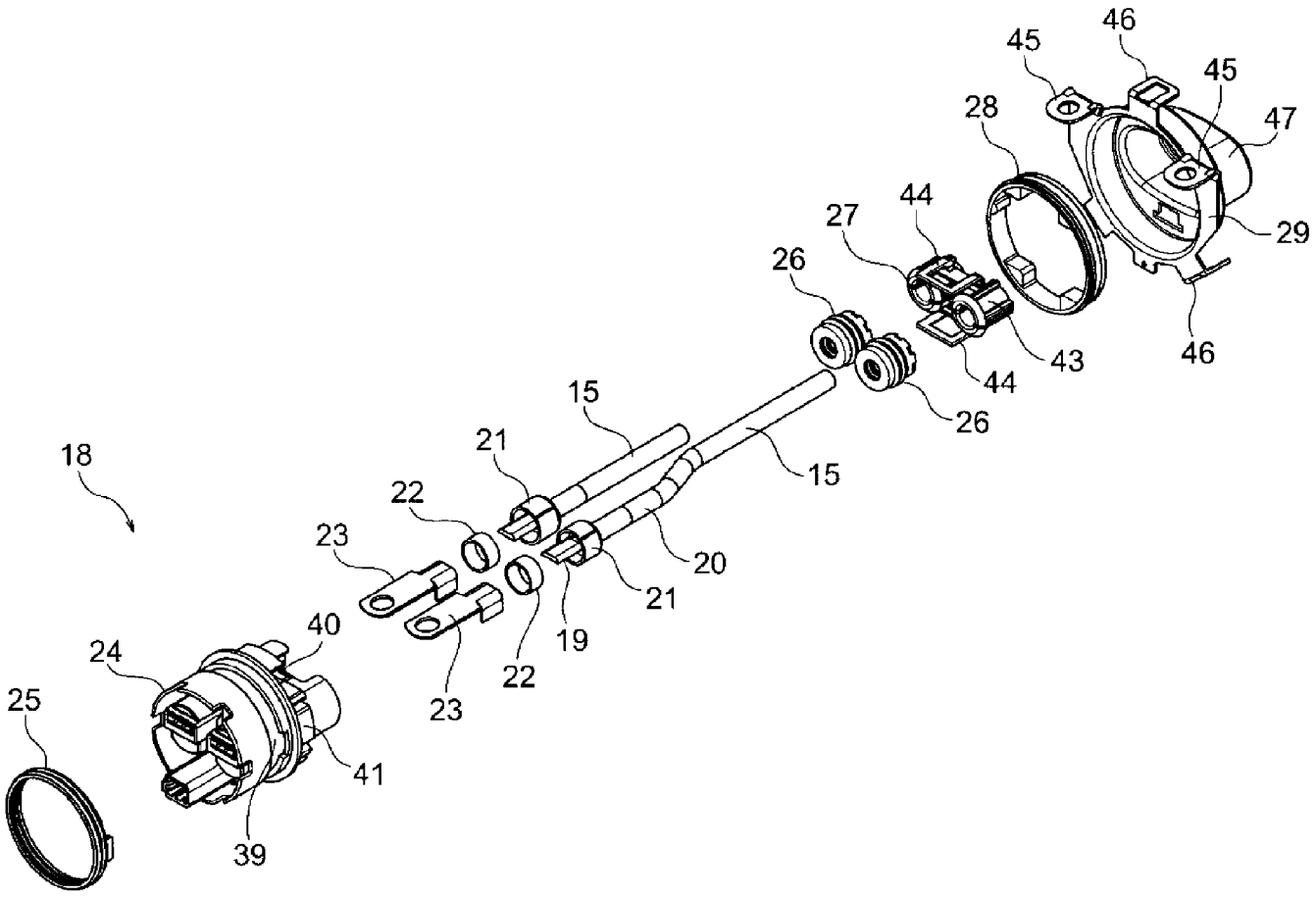
FIG. 3 is an exploded perspective view of the shield connector.
Figure 4:
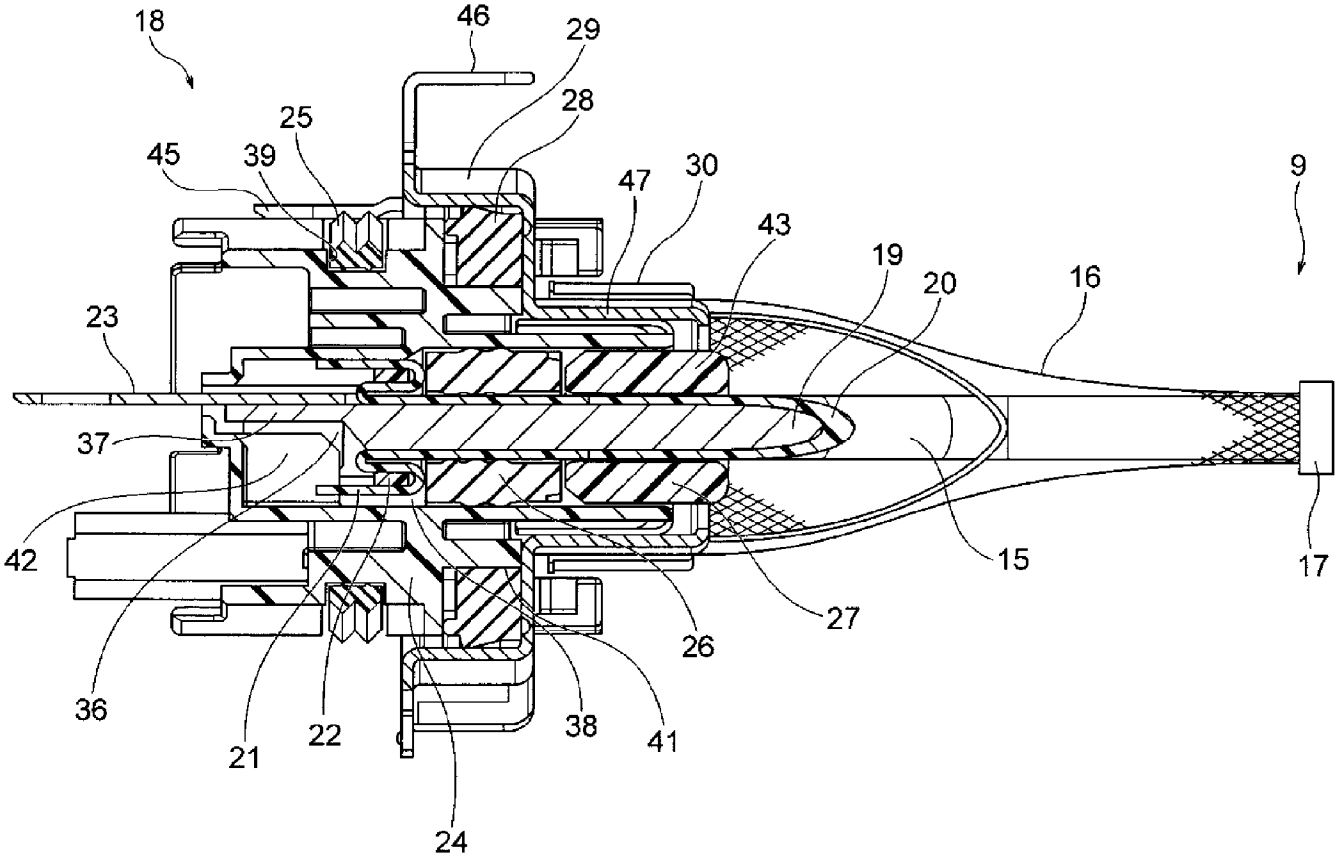
FIG. 4 is a sectional view of the shield connector taken on line A-A in FIG. 2.

An embodiment will be described below with reference to the drawings. FIGS. 1A and 1B are views about a live portion protection structure and a connector according to the invention. FIG. 1A is a view illustrating a state in which wire harnesses have been arranged, and FIG. 1B is a perspective view of an end portion of one of the wire harnesses. In addition, FIG. 2 is a perspective view illustrating the outline of a shield connector. FIG. 3 is an exploded perspective view of the shield connector. FIG. 4 is a sectional view taken on line A-A in FIG. 2.

In the embodiment, the invention is applied to a wire harness to be arranged in a hybrid car (which may be replaced by an electric car).

In FIGS. 1A and 1B, the reference numeral 1 represents a hybrid car. The hybrid car 1 is a vehicle driven by a mixture of two power sources, that is, an engine 2 and a motor unit 3. Electric power is supplied from a battery 5 (battery pack) to the motor unit 3 through an inverter unit 4. In the embodiment, the engine 2, the motor unit 3, and the inverter unit 4 are mounted in an engine room 6 where there are front wheels etc. On the other hand, the battery 5 is mounted in a car rear portion 7 where there are rear wheels etc. (it may be mounted in a car cabin located at the rear of the engine room 6).

The motor unit 3 and the inverter unit 4 are connected through a high-voltage wire harness 8. On the other hand, the battery 5 and the inverter unit 4 are also connected through a wire harness 9. An intermediate portion 10 of the wire harness 9 is arranged on a vehicle underfloor 11. In addition, the intermediate portion 10 is arranged substantially in parallel to the vehicle underfloor 11. The vehicle underfloor 11 is a known body, which is also a so-called panel member. Through holes are formed in predetermined positions of the vehicle underfloor 11. The wire harness 9 is watertightly inserted into the through holes.

The wire harness 9 and the battery 5 are connected through a junction block 12 provided in the battery 5. A rear end 13 of the wire harness 9 is electrically connected to the junction block 12 through a shield connector. On the other hand, a front end 14 side of the wire harness 9 is also electrically connected to the inverter unit 4 through a shield connector. Incidentally, the aforementioned shield connectors will be described later.

The motor unit 3 includes a motor and a generator. On the other hand, the inverter unit 4 includes an inverter and a converter. The motor unit 3 is formed as a motor assembly including a shield case. The inverter unit 4 is also formed as an inverter assembly including a shield case. The battery 5 is a modularized one based on Ni—MH or Li-ion. For example, an electric storage device such as a capacitor may be used. Not to say, the battery 5 is not limited especially as long as it can be used in the hybrid car 1 or an electric car.

In FIGS. 1A to 2, the long wire harness 9 arranged passing through the vehicle underfloor 11 includes two high-voltage electric wires 15, a cylindrical braid 16 covering the high-voltage electric wires 15 in a lump, a packing member 17 receiving and protecting the high-voltage electric wires 15 and the braid 16, a shield connector 18 (connector) provided at the end portions of the high-voltage electric wires 15 and the braid 16, and a plurality of not-shown fixing members (such as clamps) and a plurality of not-shown water stopper members (such as grommets) placed on the external surface of the packing member 17.

In the wire harness 9, a live portion protection structure according to the invention is used for the end part (end portions of the high-voltage electric wires 15 and the shield connector 18). As will be understood from the following description, the wire harness 9 has an effect that safety can be secured, for example, even when disconnection occurs.

Description will be made about the aforementioned constituents of the wire harness 9 and about the live portion protection structure according to the invention.

In FIG. 2 to FIG. 4, each electric wire 15 includes a conductor 19 and an insulator 20 (cover) provided outside the conductor 19. The electric wire 15 is formed with length required for electric connection. The high-voltage electric wire 15 is formed to be long enough for the wire harness 9 to electrically connect the inverter unit 4 and the battery 5 (junction block 12) (see FIGS. 1A and 1B).

The conductor 19 is produced out of copper, a copper alloy, aluminum or an aluminum alloy. The conductor structure of the conductor 19 is not limited especially. A conductor structure in which strands have been twisted is used in the embodiment. The insulator 20 made of an insulating resin material is formed on the external surface of the aforementioned conductor 19 by extrusion molding.

The insulator 20 is formed as a part covering the external surface of the conductor 19 with a predetermined thickness to protect the conductor 19 from the outside and to secure insulation from the outside. An extra-length portion 21 that is a characteristic part of the invention is formed integrally with an end portion of the insulator 20 configured thus. In addition, an insulating ring 22 is provided near the extra-length portion 21. The insulating ring 22 corresponds to a misalignment preventing member stated in the claims. Incidentally, the extra-length portion 21 that is a characteristic part of the invention, and the insulating ring 22 that serves as a misalignment preventing member will be described later with reference to FIG. 5 and FIG. 6.

A terminal fitting 23 that will be described later is connected to the conductor 19 exposed at the end portion of the high-voltage electric wire 15.

The braid 16 is a shield member for providing an electromagnetic shielding measure. Extremely thin strands having conductivity are woven and formed into a cylindrical shape as described above. The braid 16 is formed to be long enough to cover substantially all the length of the high-voltage electric wire 15. Incidentally, the shield member is not limited to the braid 16. For example, metal foil or a metal pipe may be used. When the metal pipe is used, the packing member 17 that will be described later may be replaced by the metal pipe.

The packing member 17 is a tubular body made of resin and covering the two high-voltage electric wires 15 and the braid 16. The packing member 17 is formed to be long enough to insert the high-voltage electric wires 15 and the braid 16 thereto and receive them therein and to be thick enough to protect them. In the embodiment, the packing member 17 is formed to be long. Incidentally, the packing member 17 is not limited to the aforementioned one made of resin, but may be made of metal, or resin and metal may be mixed partially.

The shield connector 18 is provided as a connection member to a high-voltage device. The shield connector 18 provided thus includes terminal fittings 23, a housing 24, a packing 25, rubber plugs 26 (regulation members), a rear holder 27, a waterproofing member 28, a shield shell 29, and a shield ring 30.

Each terminal fitting 23 is a metal component for electric connection. The terminal fitting 23 is formed by press working out of a metal plate having conductivity. The terminal fitting 23 formed thus includes an electric contact portion 31, an electric wire connection portion 32, and a terminal intermediate portion 33 connecting them (see FIG. 5 and FIG. 6). For example, the terminal fitting 23 is formed into an illustrated shape. The terminal fitting 23 is formed as a male terminal in the embodiment.

The electric contact portion 31 is a part for electric connection to a mating terminal. The electric contact portion 31 is formed like a tab. A circular through hole 34 is formed in the electric contact portion 31 (see FIG. 5 and FIG. 6). On the other hand, the electric wire connection portion 32 is formed as a part for electric connection to the conductor 19 of the high-voltage electric wire 15. In the embodiment, the electric wire connection portion 32 is formed into an illustrated shape, including an electric wire fixing portion 35 and a pair of held pieces 36. The electric wire fixing portion 35 is formed so that it can connect and fix the conductor 19 by welding.

The pair of held pieces 36 are formed like walls rising from opposite side portions of the electric wire fixing portion 35. The pair of held pieces 36 are formed into shapes which can be inserted into terminal holding portions 42 of the housing 24 and held by the terminal holding portions 42. The terminal holding portions 42 will be described later. The electric wire connection portion 32 is formed into an approximate U-shape in section, which is made of the shapes of the electric wire fixing portion 35 and the pair of held pieces 36. Incidentally, the pair of held pieces 36 may be replaced by a pair of electric wire caulking pieces so that the conductor 19 can be connected and fixed by the electric wire caulking pieces.

The reference numeral 37 represents a connection part between the terminal fitting 23 and the conductor 19. The conductor 19 is connected and fixed by welding as described above. Therefore, disconnection may occur easily in the boundary between the conductor 19 and the welded part. For example, when disconnection occurs, a part of the conductor 19 protrudes on the high-voltage electric wire 15 side. When a part of the conductor 19 protrudes (or is exposed) in the state where the high-voltage electric wire 15 has been connected to the battery 5 (see FIGS. 1A and 1B), the protruding part serves as a live part. Therefore, it can be said as dangerous. As a solution, a live portion protection structure according to the invention is effective. This will be described later with reference to FIG. 4, FIG. 5, FIG. 6, FIG. 7, FIG. 10 and FIG. 11.

The housing 24 is an insulating component formed by resin molding. In the embodiment, the housing 24 is formed into an approximately cylindrical outline shape. Inside the housing 24 formed thus, a reception portion 38 for receiving the end portions of the electric wires and the terminal fittings 23 is formed. In addition, outside the housing 24, a packing receiving groove 39, a rear holder locking portion 40, a waterproofing member attachment portion 41, etc. are formed. The external portion of the housing 24 also serves as a part to which the shield shell 29 can be attached.

The reception portion 38 is formed by a circular opening made in a rear portion of the housing 24. In addition, the reception portion 38 is formed to provide a desired internal space extending to the front from the rear portion of the housing 24. The internal space forms a reception path stated in the claims. Further, the reception portion 38 is formed into a shape in which only the electric contact portions 31 of the terminal fittings 23 can protrude on the front side of the housing 24. The terminal holding portions 42 for holding the held pieces 36 of the terminal fittings 23 are formed near the part where the electric contact portions 31 can protrude. Each terminal holding portion 42 is formed into a shape that can hold the corresponding held piece 36. The reception portion 38 configured thus is formed so that the connection parts 37 between the terminal fittings 23 and the conductors 19 can be protected from the outside.

The packing receiving groove 39 is formed as a part in which the packing 25 can be received and mounted. The packing receiving groove 39 is formed and disposed on the front side of the housing 24. The packing receiving groove 39 is formed into an annular groove-like shape. The packing 25 received and mounted in the packing receiving groove 39 formed thus is brought into tight contact with a connector fitting hole formed in a shield case of a high-voltage device, so as to prevent moisture or the like from invading. The packing 25 is formed into an annular shape, including a lip part in its external surface. The packing 25 functions as a waterproofing member outside the housing 24.

The rear holder locking portion 40 is formed as a part that can catch and lock the rear holder 27. The rear holder locking portion 40 is formed and disposed on the rear side of the housing 24. In addition, the rear holder locking portion 40 is formed and disposed as a pair of upper and lower parts.

The waterproofing member attachment portion 41 is formed as a part in which the waterproofing member 28 can be received and mounted. The waterproofing member attachment portion 41 is formed and disposed in an intermediate portion of the housing 24. The waterproofing member 28 received and mounted in the waterproofing member attachment portion 41 formed thus is brought into tight contact with the housing 24 and the shield shell 29 so as to prevent moisture or the like from invading. Incidentally, though not followed by any reference sign, positioning parts are formed in the waterproofing member attachment portion 41 and the waterproofing member 28. The positioning parts are formed as parts that can position the waterproofing member attachment portion 41 and the waterproofing member 28 when they are assembled.

Each rubber plug 26 is attached to the end portion of the corresponding high-voltage electric wire 15 in advance. The rubber plug 26 is received in the reception portion 38 together with the corresponding terminal fitting 23. When the rubber plug 26 is received in the reception portion 38, the rubber plug 26 is brought into tight contact with the insulator 20 serving as the cover of the high-voltage electric wire 15 and the inner surface of the reception portion 38, so as to prevent moisture or the like from invading. The rubber plug 26 functions as a waterproofing member inside the housing 24. The rubber plug 26 is formed by an elastic body that can generate a pressing force toward the inside of the electric wire. Incidentally, though not followed by any reference sign, the rubber plug 26 includes an electric wire insertion hole, a lip, etc.

The rubber plug 26 has not only the aforementioned function as a waterproofing member but also a function as a pressing member in the embodiment. The pressing member is one of characteristic parts of the invention. Here, the rubber plug 26 also serves as the pressing member (the pressing member corresponds to a regulation member stated in the claims. Such a pressing member may be provided as a separate component. In the embodiment, the rubber plug 26 is used in order to suppress increase in number of components. Incidentally, a modification of the rubber plug 26 will be described later).

The function of the pressing member, that is, the function of the regulation member may include a function of acting on the extra-length portion 21 to move the extra-length portion 21 to the outside of a disconnection part 49 so as to cover the disconnection part 49, or a function of generating a pressing force toward the inside of the electric wire.

The rear holder 27 is an insulating component formed by resin molding. The rear holder 27 is fitted and locked to the rear side of the housing 24. The rear holder 27 is attached to the end portions of the high-voltage electric wires 15 prior to the rubber plugs 26 (incidentally, this shall not apply to the case where the rear holder 27 has a split-type structure).

The rear holder 27 configured thus includes a rear holder body 43, and a pair of lock arms 44. The rear holder body 43 is formed into a shape in which two approximately cylindrical parts are arranged. The rear holder body 43 is formed in accordance with the shape of the reception portion 38. The rear holder body 43 is formed so that it can support the high-voltage electric wires 15 or it can regulate rearward movement of the rubber plugs 26. The lock arms 44 are formed as parts that can be caught and locked to the rear holder locking portion 40 of the housing 24. Specifically, each lock arm 44 is formed into a frame-like U-shape having flexibility.

The shield shell 29 is a conductive metal component. The shield shell 29 is attached to the outside of the housing 24 and fixed to a not-shown shield case of a high-voltage device by bolting. A plurality of reference signs 45 and 46 represent fixing portions. When the shield shell 29 itself is fixed to the shield case, the shield shell 29 puts the housing 24 in an immobile state. The shield shell 29 includes a cylindrical portion 47. The cylindrical portion 47 is covered with the braid 16.

The shield ring 30 is an annular metal component provided outside the cylindrical portion 47. The shield ring 30 is deformed by caulking to fix the braid 16 put over the cylindrical portion 47. The braid 16 is grounded to the not-shown shield case of the high-voltage device by the shield ring 30 and the shield shell 29.

Figure 5:
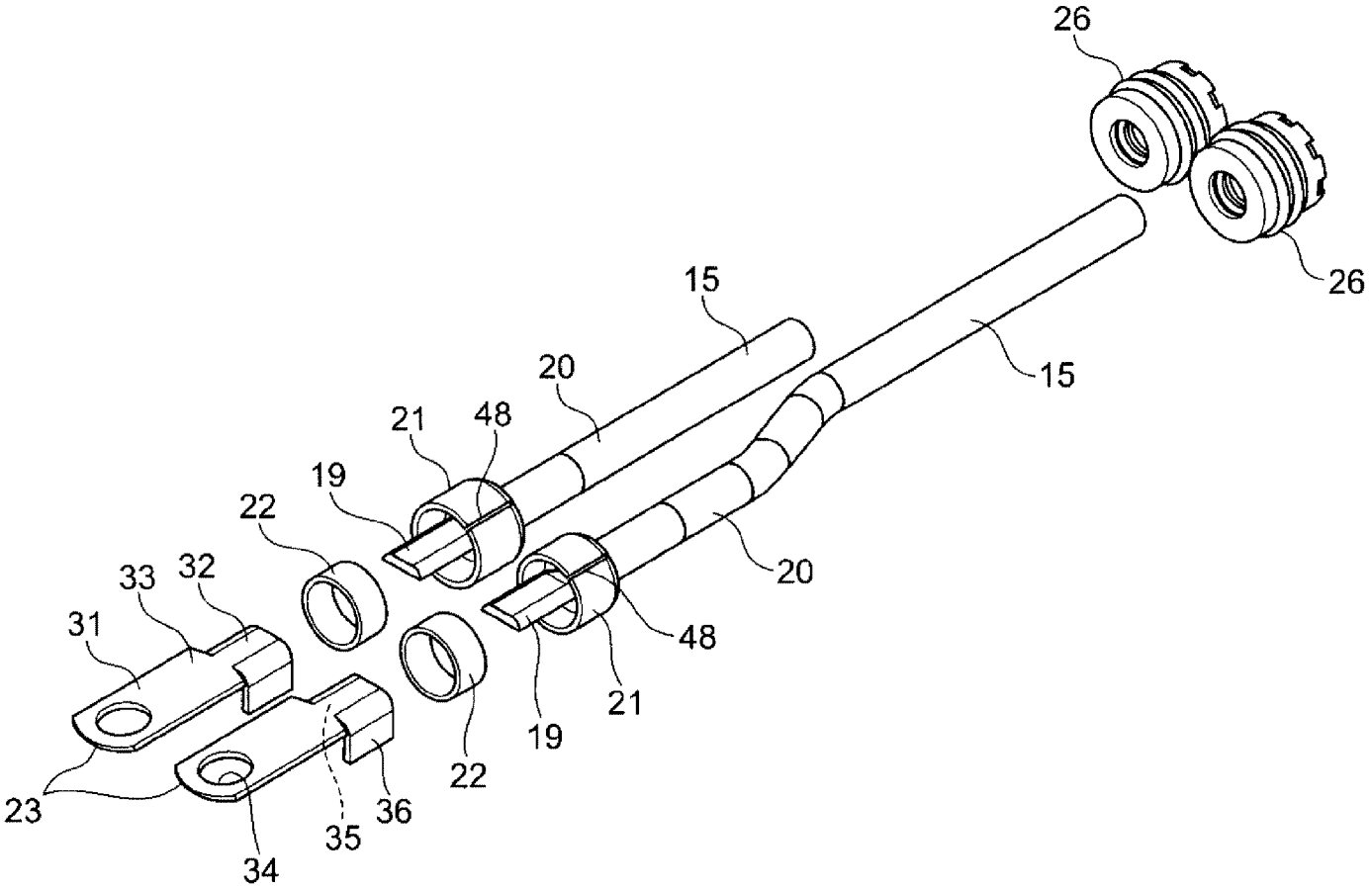
FIG. 5 is an exploded perspective view illustrating end portion side configurations of high-voltage electric wires.
Figure 6:
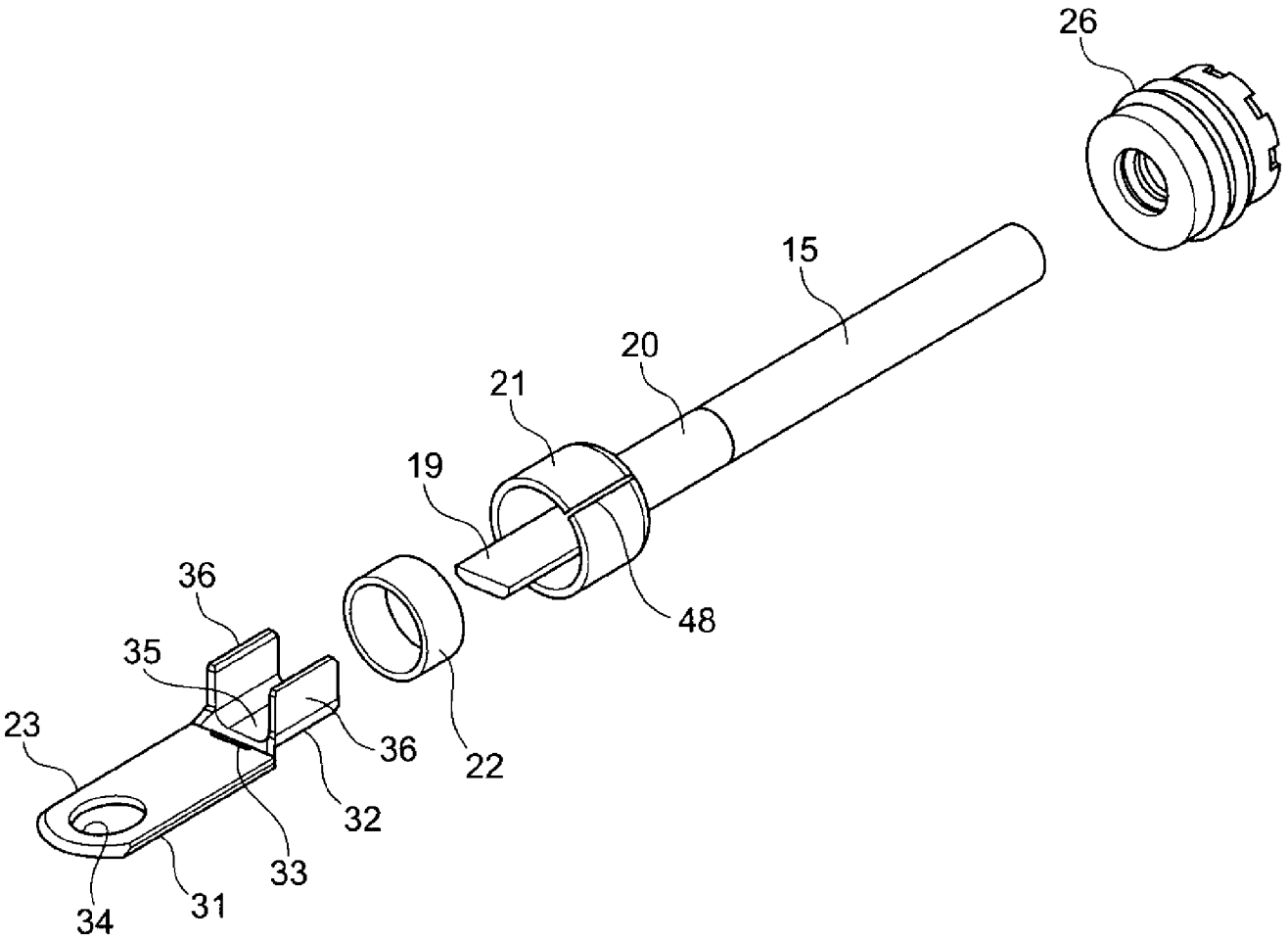
FIG. 6 is an exploded perspective view illustrating a state in which the orientation of FIG. 5 has been changed.
Figure 7:
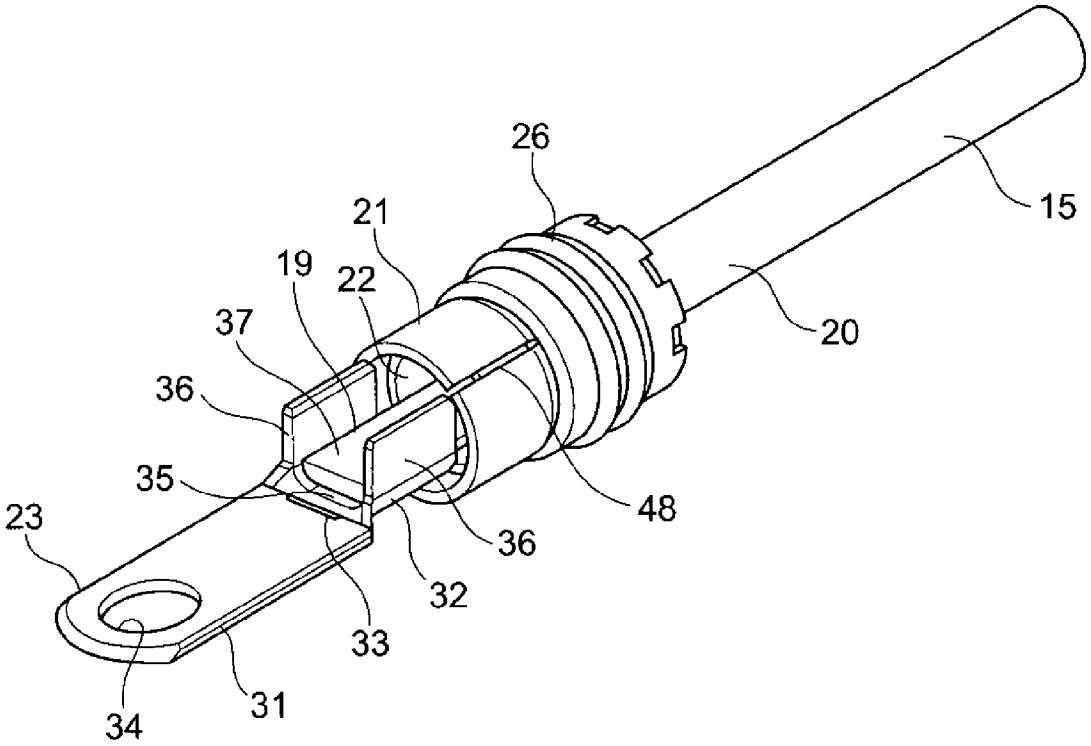
FIG. 7 is a perspective view illustrating the end portion side outline of a high-voltage electric wire.

FIG. 5 is an exploded perspective view illustrating end portion side configurations of high-voltage electric wires. In addition, FIG. 6 is an exploded perspective view illustrating a state in which the orientation of FIG. 5 has been changed. FIG. 7 is a perspective view illustrating the end portion side outline of one of the high-voltage electric wires. Further, FIG. 4 is a sectional view of the shield connector 18 as described above.

In FIG. 4 to FIG. 7, the live portion protection structure according to the invention includes an extra-length portion 21 provided in the insulator 20 at the end portion of each high-voltage electric wire 15, and a rubber plug 26 serving as a regulation member for moving the extra-length portion 21 at the time of disconnection. In addition, in the embodiment, the configuration includes an insulating ring 22 serving as a misalignment preventing member.

Operation will be described briefly before description about each constituent of the live portion protection structure. Assume that disconnection occurs in the connection part 37 between the terminal fitting 23 and the conductor 19. In this case, even when the high-voltage electric wire 15 is dropping out from the housing 24 (see FIG. 4), the live portion protection structure operates to cover a disconnection part (the reference numeral 49 in FIG. 11) with the extra-length portion 21 in the dropping-out process.

For example, the extra-length portion 21 may be formed by an extra length provided in the insulator 20 of the high-voltage electric wire 15, or may be formed by a bonding agent or the like post-fitted to the insulator 20. The former is used in the embodiment. The insulator 20 is expanded outward at the end portion of the high-voltage electric wire 15 so as to provide an extra length to thereby form the extra-length portion 21. To say other words, the insulator 20 is formed into a hood-like shape to form the extra-length portion 21. When the extra-length portion 21 that has been expanded is narrowed, the extra-length portion 21 can be formed into the length with which the disconnection part 49 that will be described later is covered. The extra-length portion 21 has slits 48 in order to be easily formed into the expanded state or the narrowed state. The slits 48 are formed to extend straightly in the axial direction of the electric wire. In the embodiment, four slits are formed (or the extra-length portion 21 is divided into four. Incidentally, the number of slits is one of examples).

The extra-length portion 21 is formed by making two folded parts each having an S-shape in section (the shape is one of examples). Due to the two folded parts, the extra-length portion 21 has a shape in which the conductor 19 connected to the terminal fitting 23 can be exposed in an initial state. Incidentally, since the extra-length portion 21 is formed by making the two folded parts in such a manner, the insulating ring 22 is effective to prevent misalignment.

The insulating ring 22 is an insulating component formed by resin molding. The insulating ring 22 is formed into a ring-like shape (cylindrical shape shorter in the axial direction). The insulating ring 22 formed thus has an inner diameter with which the insulating ring 22 can be inserted between the first folded part and the second folded part in the extra-length portion 21. The insulating ring 22 is formed to have a comparatively gentle holding force with which misalignment of the extra-length portion 21 cannot occur in a state where no external force is applied. To say other words, the insulating ring 22 is formed to have a holding force with which the insulating ring 22 can be attached and removed easily.

Incidentally, when the insulating ring 22 is provided, misalignment of the extra-length portion 21 can be prevented from occurring. Accordingly, although the extra-length portion 21 is formed with an extra length, the insulating ring 22 set in a predetermined position can prevent the extra-length portion 21 from hindering welding between the terminal fitting 23 and the conductor 19. Thus, it is a matter of course that good connectivity can be secured.

The rubber plug 26 is attached to the end portion of the high-voltage electric wire 15 in advance as described above. After the extra-length portion 21 and the insulating ring 22 are assembled, and after the terminal fitting 23 and the conductor 19 are welded, the rubber plug 26 is pulled into the vicinity of the extra-length portion 21. In the embodiment, the rubber plug 26 is pulled up to a position where the rubber plug 26 can abut against the extra-length portion 21. The state at that time is shown in FIG. 7.

Next, description will be made about attachment of the shield connector 18. After that, description will be made about the operation of the live portion protection structure according to the invention.

Figure 8:
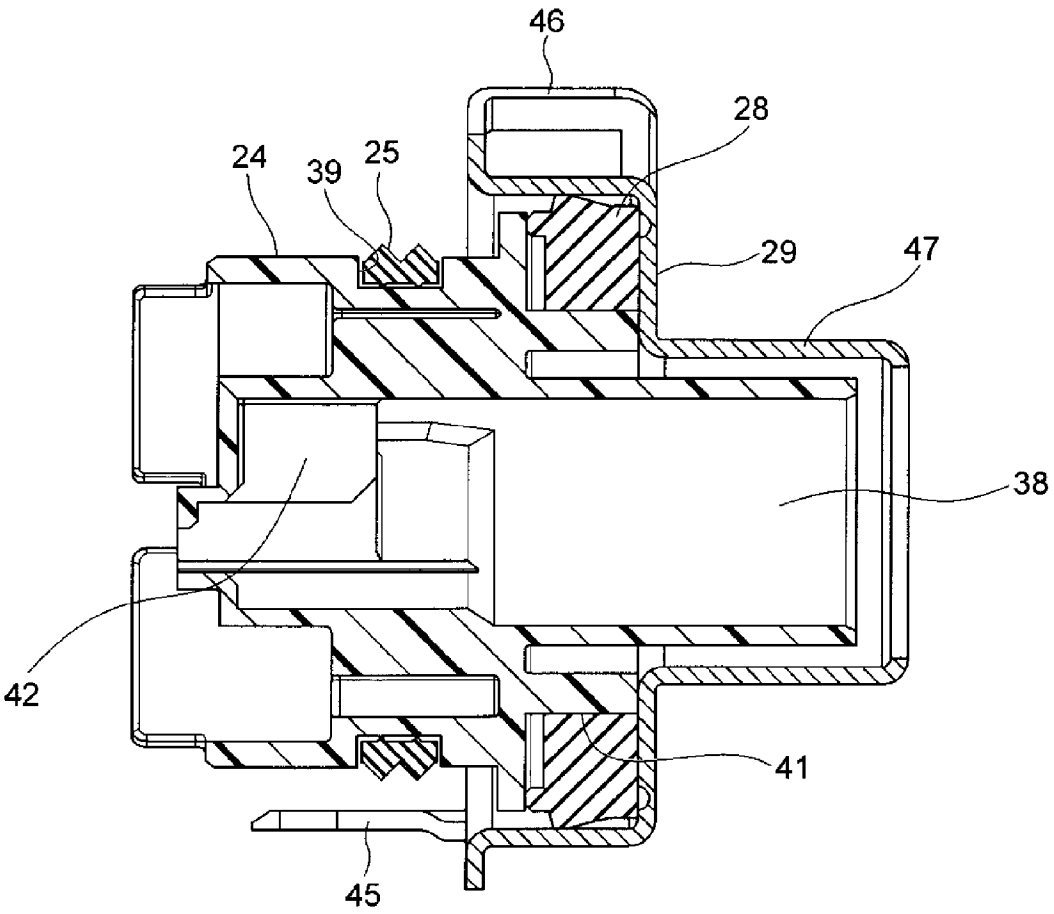
FIG. 8 is a sectional view illustrating a state of a housing etc. in which the high-voltage wire has not been placed yet.
Figure 9:
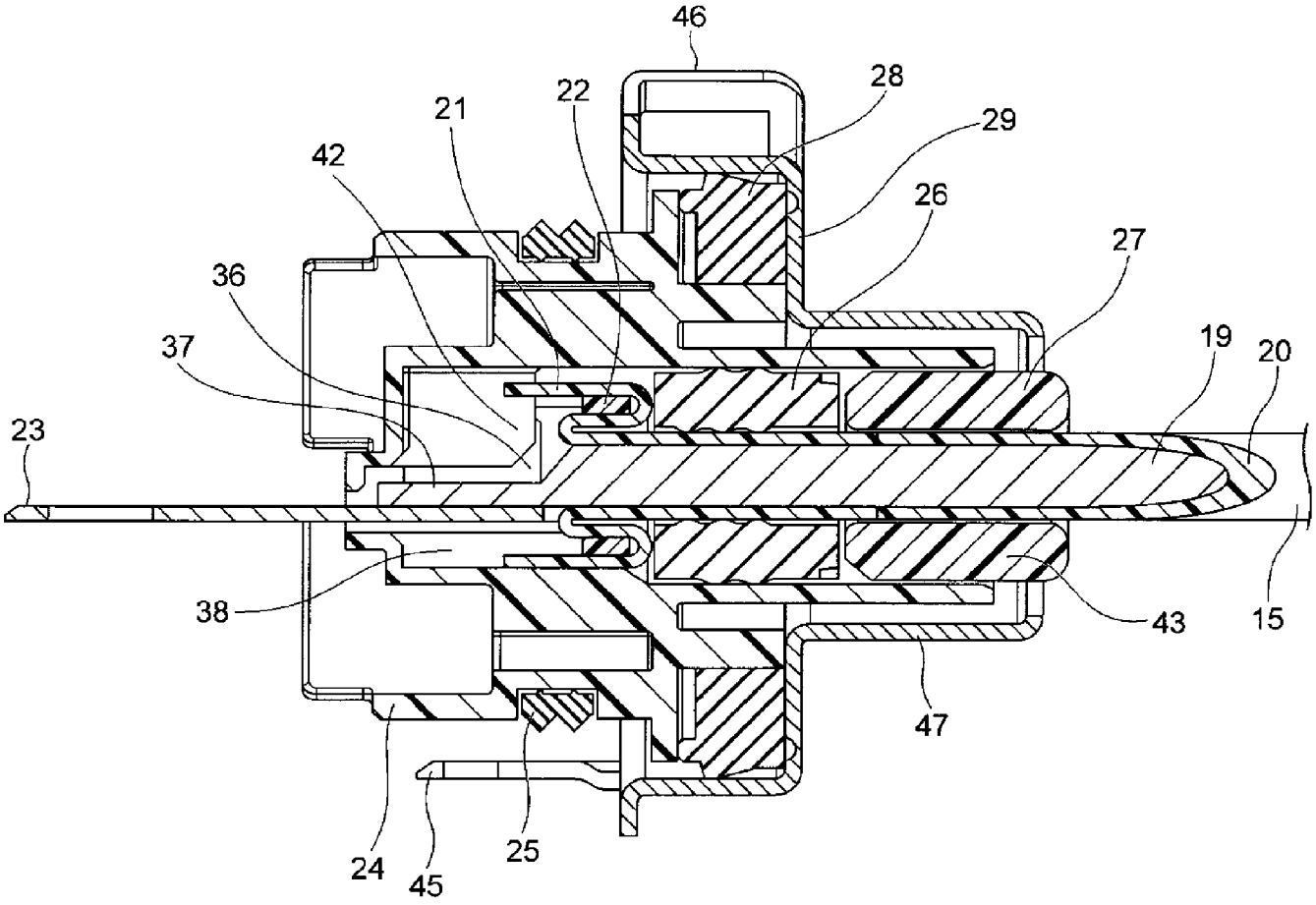
FIG. 9 is a sectional view illustrating a state in which the high-voltage wire has been placed.
Figure 10:
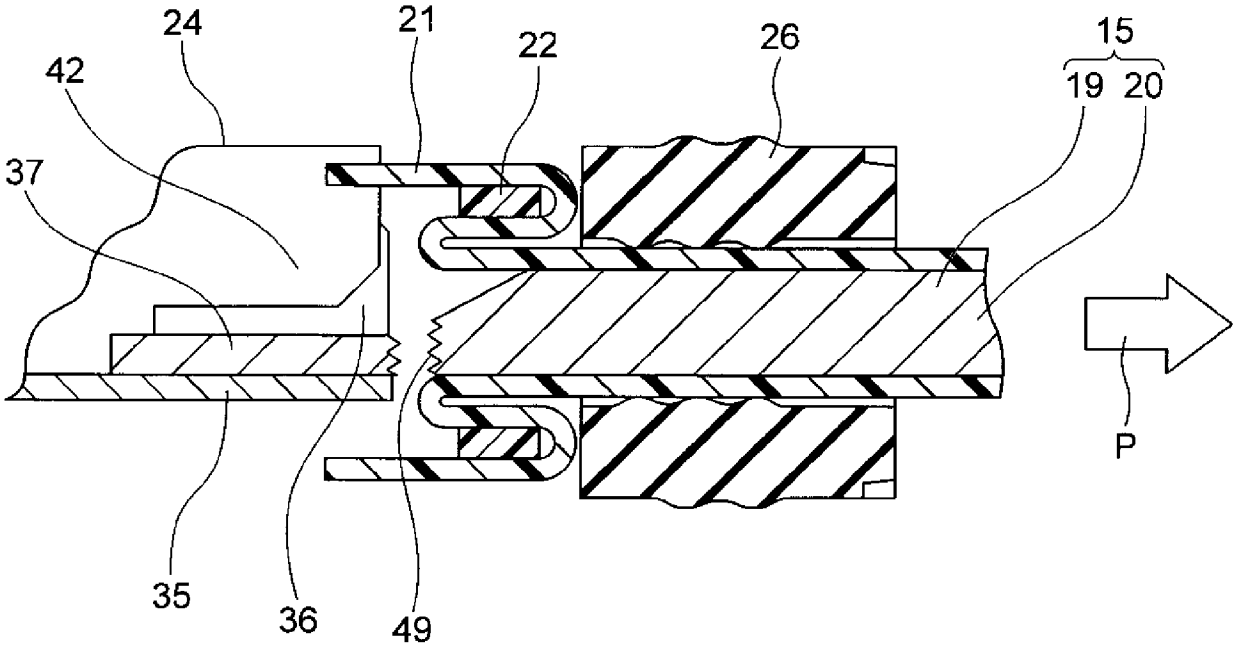
FIG. 10 is a sectional view illustrating a state in which, for example, disconnection has occurred.
Figure 11:
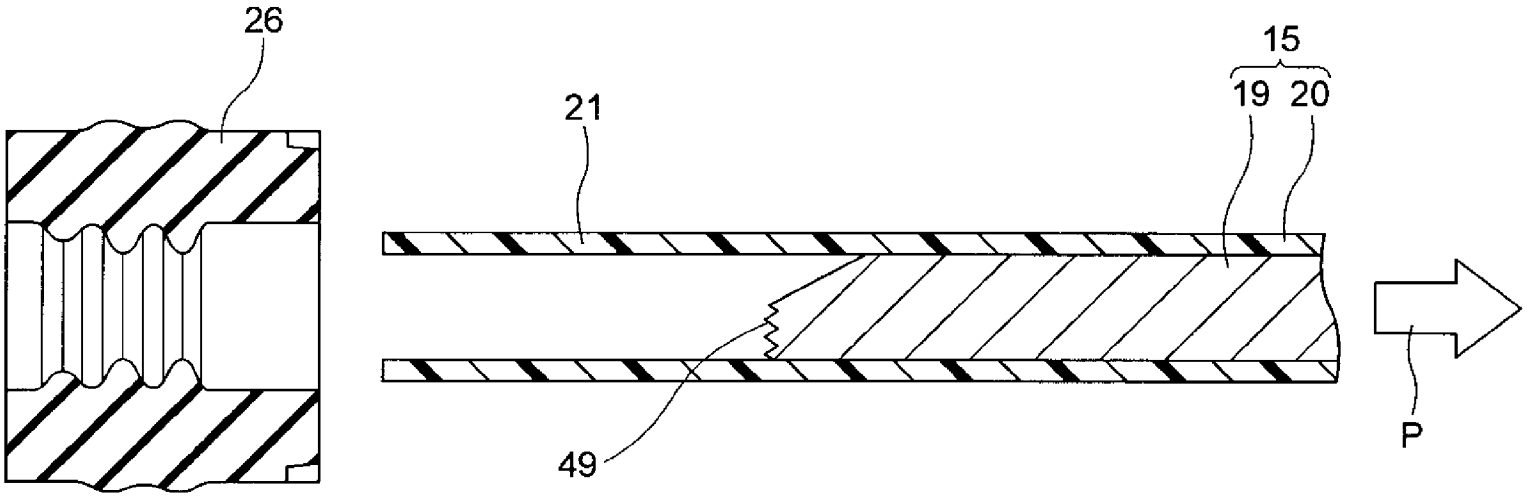
FIG. 11 is a sectional view illustrating a state in which a disconnection part has been covered with an extra-length portion.

FIG. 8 is a sectional view illustrating a state of a housing etc. in which a high-voltage wire has not been placed yet. In addition, FIG. 9 is a sectional view illustrating a state in which the high-voltage wire has been placed. FIG. 10 is a sectional view illustrating a state in which disconnection has occurred. FIG. 11 is a sectional view illustrating a state in which a disconnection part has been covered with an extra-length portion.

In FIG. 8, first, the packing 25, the waterproofing member 28, and the shield shell 29 are attached to the housing 24 in predetermined procedures respectively. Next, the end portions of the high-voltage electric wires 15 each arranged as shown in FIG. 7, that is, the end portions of the high-voltage electric wires 15 to which the terminal fittings 23 are connected and which include the extra-length portions 21 etc. are inserted into the housing 24 from its back. Thus, each end portion is received in the reception portion 38 as shown in FIG. 9. On this occasion, the held pieces 36 of the terminal fittings 23 are held by the terminal holding portions 42 of the reception portion 38. The extra-length portions 21 are received in the reception portion 38 without misalignment due to the function of the insulating rings 22. Next, the rear holder 27 is fitted and locked to the housing 24. Further, the braid 16 that is not shown in FIG. 9 is caulked by the shield ring 30. Thus, a series of operations for assembling the shield connector 18 is completed.

After that, assume that the shield connector 18 shown in FIG. 9 is connected and fixed to a high-voltage device, and in this state an excessive load is, for example, applied to one of the high-voltage electric wires 15 in the direction of the arrow P. In this case, the load concentrates in the connection part 37 between the terminal fitting 23 and the conductor 19. As a result, disconnection occurs as shown in FIG. 10 (the reference numeral 49 represents a disconnection part. Incidentally, rather than disconnection, it can be also considered that the conductor 19 drops out). When the high-voltage electric wire 15 is dropping out from the shield connector 18 (see FIG. 9) due to disconnection caused by the load, the extra-length portion 21 abuts against the rubber plug 26 held by the housing 24 or the rear holder 27. The extra-length portion 21 pushed out with the movement of the high-voltage electric wire 15 moves toward the disconnection part 49. The extra-length portion 21 that has been expanded before the disconnection is pushed out thus, and passed through the rubber plug 26. Thus, when the extra-length portion 21 drops out from the housing 24 (or from the rear holder 27), the extra-length portion 21 is narrowed as shown in FIG. 11, so as to cover the disconnection part 49. The disconnection part 49 is covered with the extra-length portion 21. In this manner, short-circuit or contact of a human body can be prevented. Accordingly, safety can be secured, for example, even when disconnection occurs.

Figure 12A:
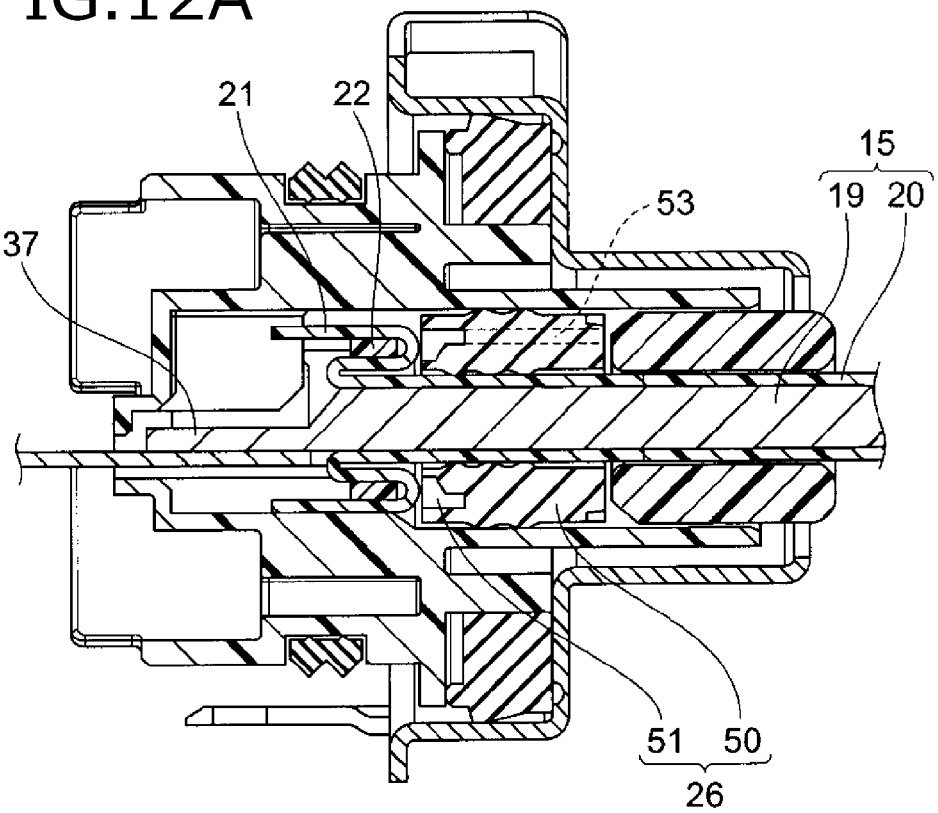
FIGS. 12A and 12B are views illustrating a modification of a rubber plug serving as a regulation member.
Figure 12B:
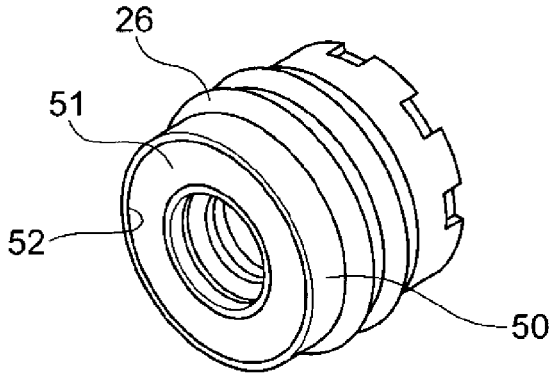
Figure 13:
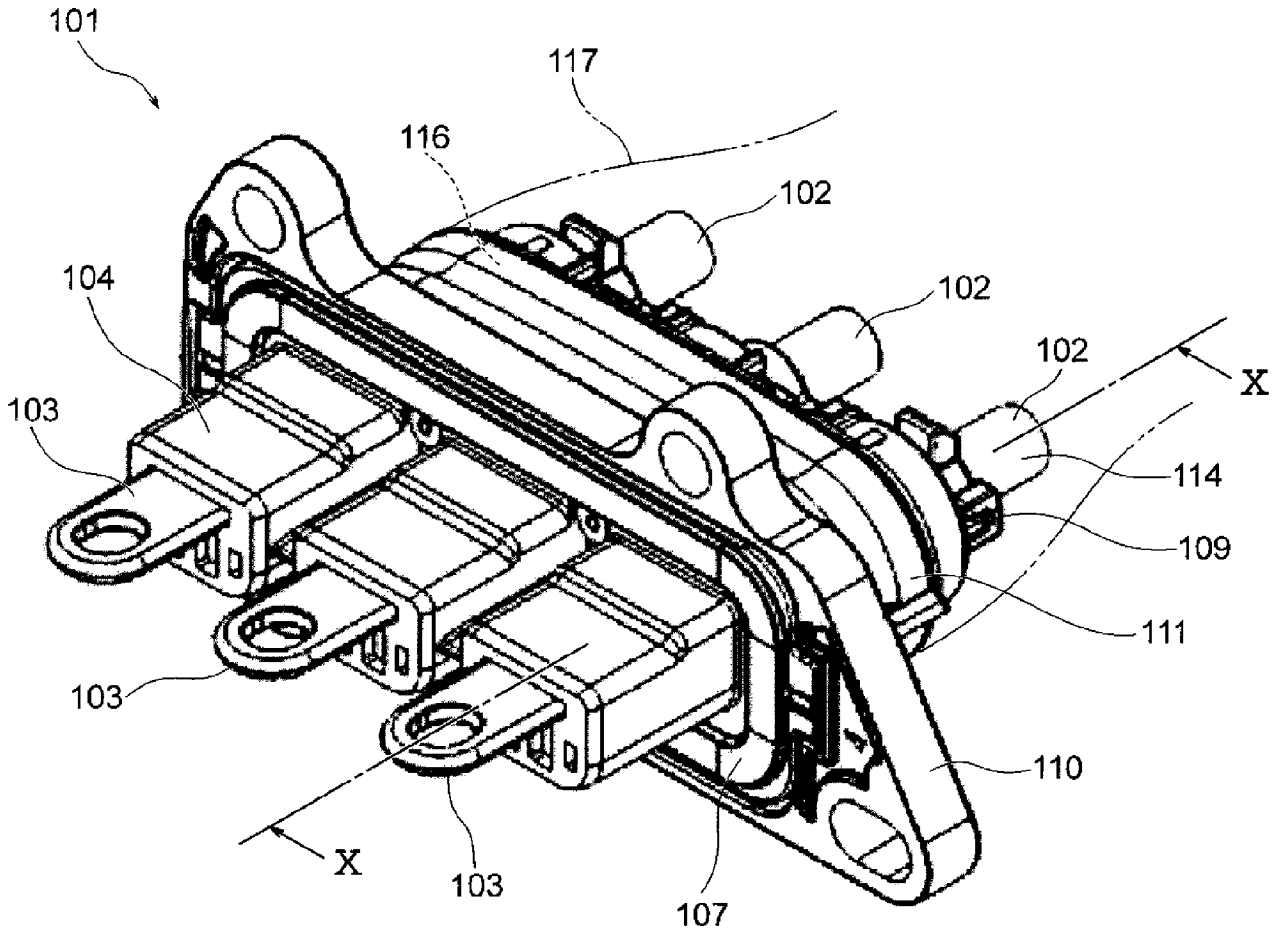
FIG. 13 is a perspective view illustrating the outline of a shield connector in a related art.
Figure 14:
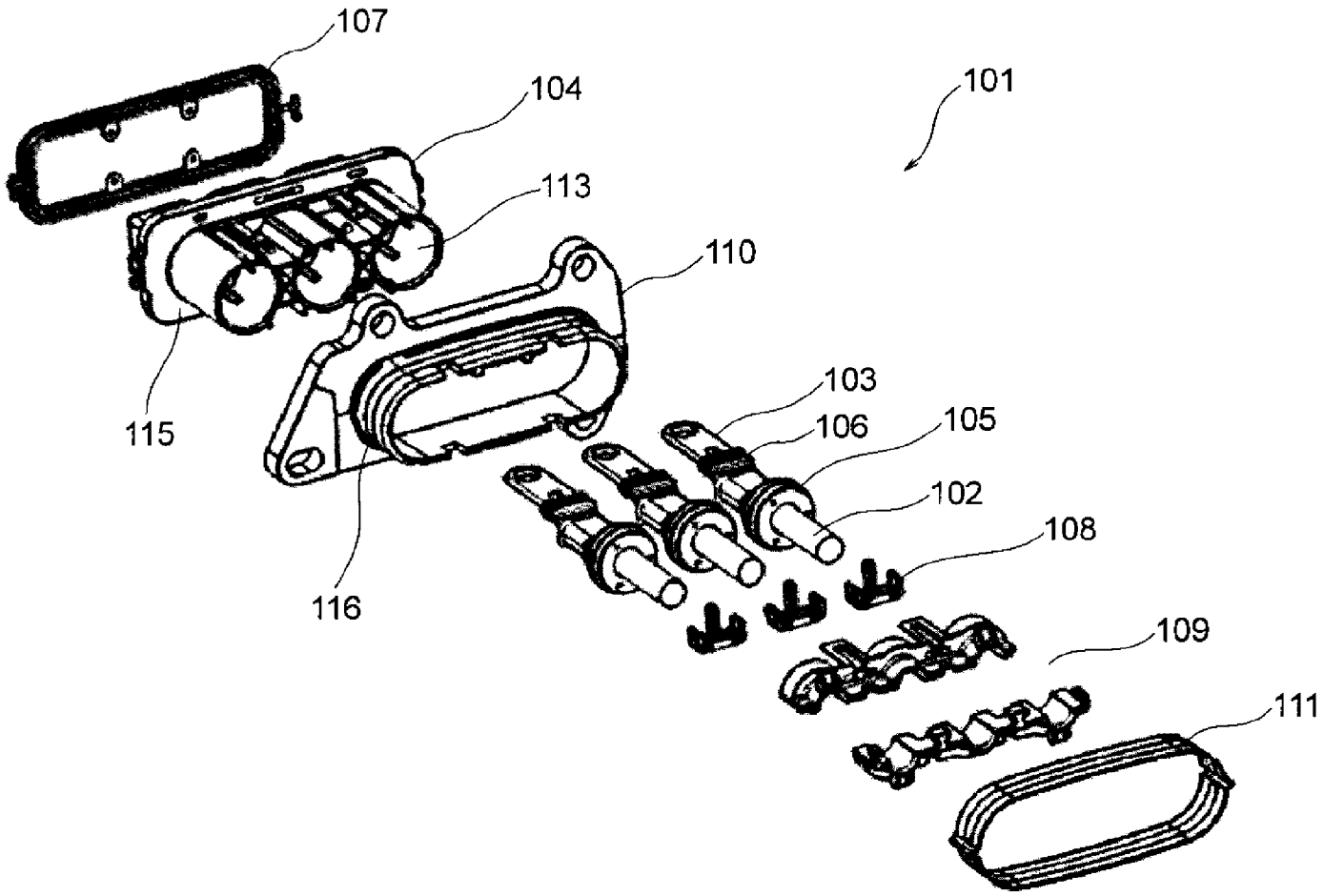
FIG. 14 is an exploded perspective view of the shield connector in FIG. 13.
Figure 15:
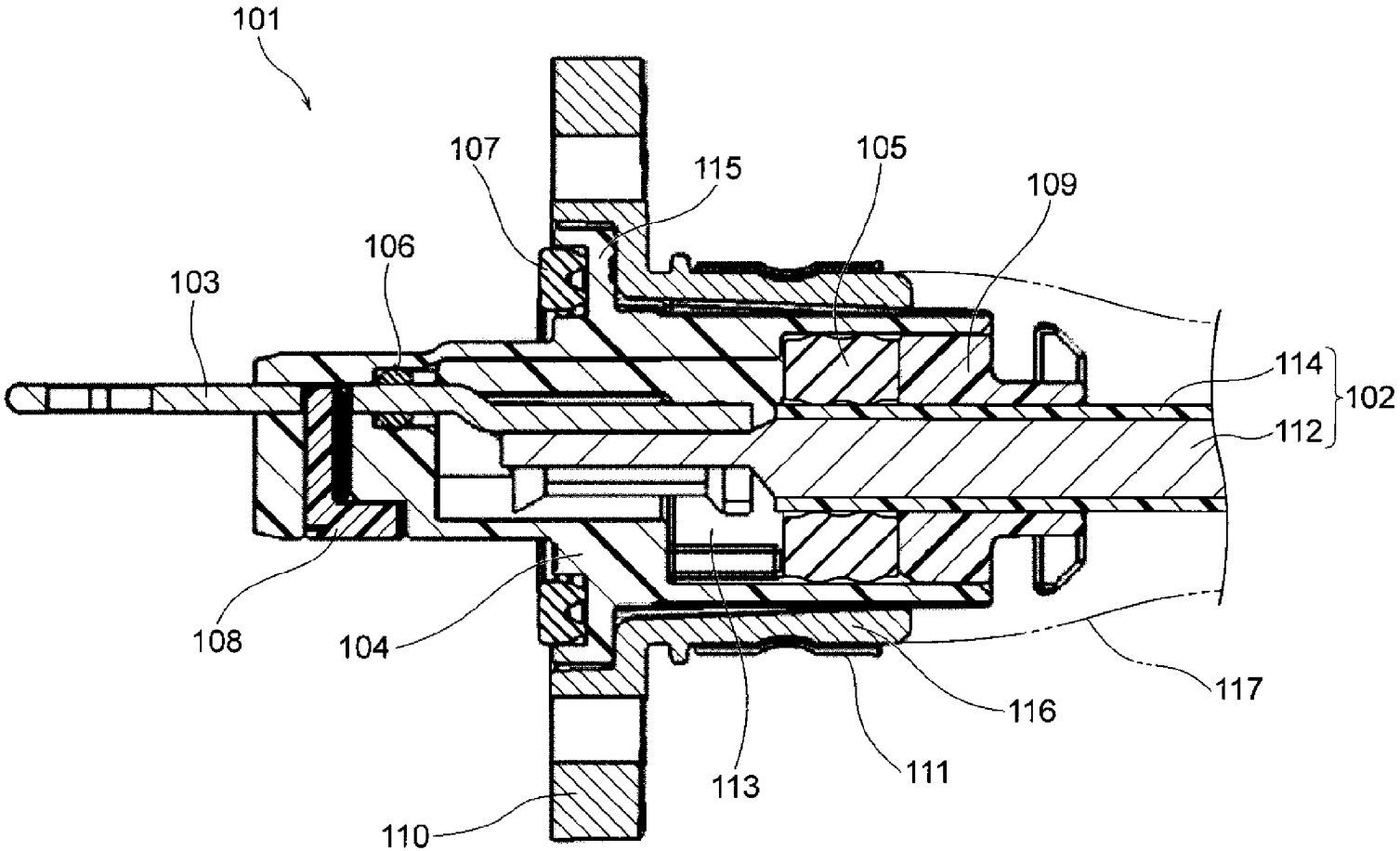
FIG. 15 is a sectional view of the shield connector taken on line X-X in FIG. 13.

Incidentally, the extra-length portion 21 abutting against the rubber plug 26 is pushed out as described above. Therefore, it can be said that a rubber plug 26 having the following configuration and structure is also effective. FIGS. 12A and 12B are views illustrating a modification of a rubber plug serving as a regulation member.

In FIGS. 12A and 12B, the rubber plug 26 according to the modification includes a rubber plug body 50, and a pressing structure portion 51. The rubber plug body 50 is formed in such a manner that a mounting portion 52 is formed in the rubber plug 26 shown in FIG. 11. The other points of the rubber plug body such as a point that it is an elastic body generating a pressing force toward the inside of the electric wire and a point that it has a function as a waterproofing member are the same as those in the rubber plug 26 shown in FIG. 11. The pressing structure portion 51 is a part for pushing out the extra-length portion 21. The pressing structure portion 51 is mounted on the mounting portion 52. The pressing structure portion 51 is mounted to expose one end surface (front surface) of the rubber plug 26. Here, the pressing structure portion 51 is formed to partially extend to the other end surface (rear surface) of the rubber plug 26. An extension portion 53 formed thus can abut against the rear holder 27. As a result, there is an advantage that the force generated when the extra-length portion 21 is pushed out can be also received by the rear holder 27. In addition, there is another advantage that the rubber plug body 50 can be prevented from being deformed more than necessary in the axial direction of the electric wire.

As described above with reference to FIGS. 1A to 12B, the shield connector 18 is provided with the extra-length portion 21 in the insulator 20 of each high-voltage electric wire 15 and provided with the rubber plug 26 as a regulation member. Further, the shield connector 18 has a structure acting on the extra-length portion 21 so that the extra-length portion 21 can move to the outside of the disconnection part 49 to thereby cover the disconnection part 49, for example, when disconnection occurs. Therefore, for example, even when the high-voltage electric wire 15 is dropping out from the housing 24 with the disconnection part 49 protruding due to the occurrence of disconnection, the disconnection part 49 is covered with the extra-length portion 21 so that the disconnection part 49 can be prevented from being exposed. Accordingly, short-circuit or contact of a human body can be prevented. Therefore, safety can be secured, for example, even when disconnection occurs.

In addition, the shield connector 18 uses the insulating ring 22 as a misalignment preventing member. Thus, misalignment of the extra-length portion 21 can be prevented. Accordingly, there is no fear that misalignment occurs when the extra-length portion 21 is placed in the housing 24. As a result, assemblability can be improved in spite of the structure including the extra-length portion 21.

Since the extra-length portion 21 has the slits 48, it is a matter of course that the extra-length portion 21 can be easily formed into a hood-like shape, easily folded twice, and easily placed in the housing 24. In addition, the extra-length portion 21 can be easily moved to the outside of the disconnection part 49 due to the operation from the rubber plug 26.

Since the rubber plug 26 generates a pressing force toward the inside of the electric wire, it is a matter of course that the rubber plug 26 can prevent the high-voltage electric wire 15 from dropping out easily. In addition, the rubber plug 26 can bring the extra-length portion 21 into contact surely, and further operate to push out the extra-length portion 21. The rubber plug 26 can surely move the extra-length portion 21 to the outside of the disconnection part 49 so as to cover the disconnection part 49 therewith. In addition, the rubber plug 26 is also used as a regulation member. Therefore, increase in number of components can be suppressed.

Not to say, various changes can be carried out on the invention without departing from the gist of the invention.

That is, although the insulating ring 22 is provided as a misalignment preventing member for the extra-length portion 21 in the aforementioned description, the invention is not limited thereto. A part (misalignment preventing member) having a similar function may be formed in the reception portion 38 of the housing 24.

In addition, although the structure for receiving the terminal fittings 23 in the housing 24 is used in the aforementioned description, the invention is not limited thereto. A structure in which the terminal fittings 23 are pulled out toward a high-voltage device and end portions of the high-voltage electric wires 15 are inserted into the housing 24 may be used.

The invention has been described in detail and with reference to a specific embodiment. However, it is obvious for those in the art that various changes or modifications can be made on the invention without departing from the spirit and scope of the invention.

What is claimed is:

1. A live portion protection structure comprising:

a high-voltage electric wire that comprises a conductor having conductivity and an insulating cover covering the conductor, the conductor includes an exposed end portion;

a conductive terminal fitting that is connected to the exposed end portion of the conductor to form a connection part therewith;

an insulating housing including a reception path that receives the connection part into the insulating housing;

a regulation member that is disposed in the reception path; and an insulating extra-length portion that is connected to the cover and is spaced away from the connection part, wherein when at least a portion of the connection part on a side of the conductor disconnects from the conductive terminal and drops out from the housing, the extra-length portion abuts against the regulation member so as to be moved to an outside of at least the portion of the connection part to thereby cover at least the portion of the connection part.

2. The live portion protection structure according to claim 1, further comprising a misalignment preventing member that engages the extra-length portion and prevents misalignment of the extra-length portion.

3. The live portion protection structure according to claim 2, wherein the misalignment preventing member is a ring through which the extra-length portion passes.

4. The live portion protection structure according to claim 3, wherein the extra-length portion includes a first folded part and a second folded part, and the ring is inserted between the first folded part and the second folded part such that the first folded portion passes through the ring and the second folded part lies outside of the ring.

5. The live portion protection structure according to claim 1, wherein a slit is provided in the extra-length portion.

6. The live portion protection structure according to claim 1, wherein the regulation member is formed by an elastic body that generates a pressing force toward an inside of the electric wire.

7. The live portion protection structure according to claim 6, wherein a waterproofing rubber plug is used as the regulation member; and wherein an inner face of the waterproofing rubber plug is in tight contact with the cover and an outer face of the waterproofing rubber plug is in tight contact with the housing.

8. A connector provided at an end portion of a high-voltage electric wire, comprising:

the live portion protection structure according to claim 1, which is used for the connector and the end portion of the high-voltage electric wire.

9. The live portion protection structure according to claim 1, wherein the extra-length portion is formed by an extra length of the cover.

* * * * *